US007128307B2

(12) United States Patent
Dow

(10) Patent No.: US 7,128,307 B2
(45) Date of Patent: Oct. 31, 2006

(54) MANUAL MARINE WINCH WITH COMPOUND HANDLE

(75) Inventor: Justin E. Dow, Pittsburgh, PA (US)

(73) Assignee: WW Patterson Company, Pittsburgh, PA (US)

( * ) Notice: Subject to any disclaimer, the term of this patent is extended or adjusted under 35 U.S.C. 154(b) by 41 days.

(21) Appl. No.: 11/003,022

(22) Filed: Dec. 2, 2004

(65) Prior Publication Data

US 2005/0133770 A1 Jun. 23, 2005

Related U.S. Application Data

(60) Provisional application No. 60/526,228, filed on Dec. 2, 2003.

(51) Int. Cl.
*B66D 1/14* (2006.01)

(52) U.S. Cl. ..... 254/342; 254/369; 254/376; 74/545

(58) Field of Classification Search ..... 254/332, 254/342, 345, 356, 357, 369, 376; 74/545
See application file for complete search history.

(56) References Cited

U.S. PATENT DOCUMENTS 3,220,701 A * 11/1965 Clausen et al. ..... 254/359
3,939,729 A * 2/1976 Brockelsby ..... 74/575
4,106,754 A * 8/1978 Kucher ..... 254/352
4,456,227 A * 6/1984 Notenboom ..... 254/350
4,566,674 A * 1/1986 Ebey et al. ..... 254/345
5,603,489 A * 2/1997 Regal ..... 254/378
5,607,143 A * 3/1997 Regal ..... 254/342
6,116,580 A * 9/2000 Hull ..... 254/357
6,572,083 B1 * 6/2003 Topping et al. ..... 254/375
6,644,630 B1 * 11/2003 Lorenz ..... 254/376
6,726,182 B1 * 4/2004 Topping et al. ..... 254/376
6,938,881 B1 * 9/2005 Grapes ..... 254/352

* cited by examiner

*Primary Examiner*—Emmanuel M Marcelo
(74) *Attorney, Agent, or Firm*—Blynn L. Shideler; Krisanne Shideler; BLK Law Group

(57) ABSTRACT

A manual swivel winch includes safe loading mechanism. The winch has a pair of spaced side plates, a rotating drum supported between the side plates, a drum gear coaxially mounted with the rotating drum, a pinion drive gear engaging and rotating the drum gear, and a lever supported by at least one side plate for rotating the pinion drive gear. The lever includes a selectable lever gearing assembly. The lever is selected to be operated in an initial tensioning mode for rotating the pinion drive gear, and in a final tensioning mode wherein the lever utilizes the lever gearing assembly to provide a mechanical advantage over the initial tensioning mode.

14 Claims, 4 Drawing Sheets

MANUAL MARINE WINCH WITH COMPOUND HANDLE

RELATED APPLICATION

This application claims the benefit of provisional application Ser. No. 60/526,228 entitled "Manual Marine Winch with Compound Handle" filed Dec. 2, 2003.

BACKGROUND OF THE INVENTION

1. Field of the Invention

The present invention relates to manual marine winches. More specifically, the present invention relates to a compound handle providing a safety loading system for a manual marine swivel winch for barges.

2. Background Information

Winches have been used in many applications. Manual swivel and stationary marine winches have been widely used in barges, tow boats and the like. The use of barges, sometimes called lighters, to transport cargo is common in marine transportation. Barges may be used singly, or in groups generally referred to as barge trains or tows. A barge tow can have up to 40 barges therein (five wide and eight deep). The barges in a barge train carrying goods in harbors and along rivers are, usually, lashed tightly together through winches (located on opposite ends of or in the four corners of each barge) and associated cable lines, two or three (even up to five) abreast, with several successive rows of such barges in one barge train. Typically a manual swivel winch is pivotally attached to a D-ring on a barge boat deck and spools a towing cable on a rotating drum, whereas a stationary winch is welded or otherwise secured to the deck.

These marine winches must be quick and easy to use. Barge tows must be first assembled, and must disassembled for movement through locks, then reassembled on the opposite side of the locks. The marine winches are often exposed to an abrasive environment and can become immersed in coal, ore or other material being transported. Consequently, these winches also must have a sturdy construction. Examples of manual winches are sold by W. W. Patterson Company and Nashville Bridge Company. The most common type of manual winch includes a pivoting pawl, or dog, engaging a ratchet gear of a ratchet for the winch. The pawl prevents the unwinding of the reel during engagement of the pawl. W. W. Paterson manufactures a sturdy manual marine winch having an open bottom configuration that saves material and provides easy winch clean-up in U.S. Pat. No. 5,947,450 which is incorporated herein by reference in its entirety. Additionally, W. W. Patterson manufactures a sturdy manual marine winch that incorporates a safety load release mechanism improving the safety to the operator in U.S. Pat. No. 6,572,083 which is also incorporated herein by reference.

The '083 patent discloses one type of safe load release mechanism for the safety of the operators. There still is a need to address the loading operation of the winches. The loading at high tensions can provide some of the same type of dangers to the operator as the load releasing operation, particularly where additional leverage is used for loading. Additional leverage is often provided through a length (e.g. four feet) of pipe, also affectionately known as a "cheater bar", is placed over the loading lever to effectively increase the length of the loading lever. The mechanical advantage this provides is obvious. The increased in length creates additional concerns since even a small rotation of the drum, less than one gear tooth, will correspond to a noticeable movement in the end of the cheater bar. Further at high tension this can make such bar movement very rapid, such as might occur if the operator slips, or otherwise loses his grip.

It is an object of the present invention to overcome the aforementioned drawbacks of the prior art. It is a further object of the present invention to provide a manual marine swivel winch which provides simple efficient safe loading operation. It is a further object to provide a system that can be easily retrofitted onto existing marine winches.

SUMMARY OF THE INVENTION

The above stated objects are achieved with a swivel manual marine winch according to the present invention. A manual swivel winch includes safe loading mechanism. The winch has a pair of spaced side plates, a rotating drum supported between the side plates, a drum gear coaxially mounted with the rotating drum, a pinion drive gear engaging and rotating the drum gear, and a lever supported by at least one side plate for rotating the pinion drive gear. The lever includes a selectable lever gearing assembly. The lever is selected to be operated in an initial tensioning mode for rotating the pinion drive gear, and in a final tensioning mode wherein the lever utilizes the lever gearing assembly to provide a mechanical advantage over the initial tensioning mode.

These and other advantages of the present invention will be clarified in the brief description of the preferred embodiments taken together with the attached figures wherein like reference numerals represent like elements throughout.

DESCRIPTION OF THE PREFERRED EMBODIMENTS

Figure 1:
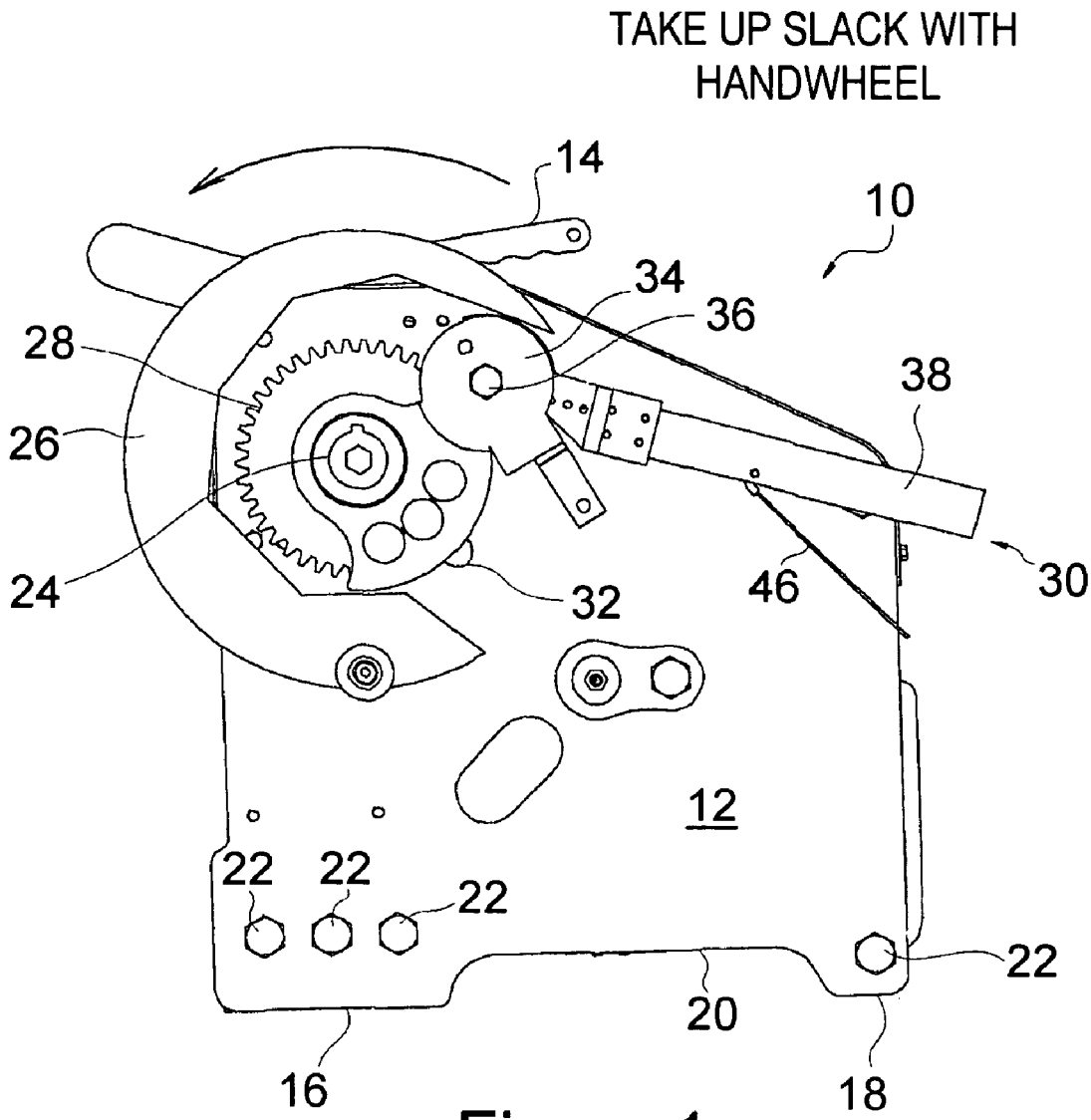
FIG. 1 is a schematic side view of a manual marine winch according to the present invention during slack take up.

FIGS. 1–5 illustrate a manual swivel winch 10 according to the present invention. The general details and operation of the winch 10 can be found in U.S. Pat. No. 5,947,450 which is incorporated herein by reference.

The winch 10 includes a pair of spaced side plates 12 defining an open bottom. A rotating spool assembly is supported between the side plates 12. The spool assembly includes a drum, one or two protecting flanges on one side of the drum and at least one drum gear on the side of the drum. A drum loading mechanism is supported by the side plates 12 and includes a drive pinion engaging the drum gear. The drive pinion gear of the loading mechanism engages with the drum gear to rotate the drum for spooling of a cable thereon as is known in the art.

A hand brake 14 may be attached to a side plate 12 for controlling the payout of the drum as known in the art. A swivel link is attached to the pair of side plates 12 at a rear of the winch 10 and pivotally attaches the winch 10 to a D-ring of a barge deck, a boat deck or the like. A rear foot 16 is formed integral with each side plate 12 near a rear of the winch 10. A front foot 18 is formed integral with each side plate 12 at a forward portion of the winch 10, and a cutout 20 extends from each front foot 18 to each rear foot 16 to assist in cleanout of the winch 10. The side plates 12 are maintained spaced from each other by appropriate spacers through associated bolts 22.

The winch 10 additionally includes a tension or load holding mechanism in the form of at least one drum gear engaging pawl. When the pawl is biased, generally by gravity, into engagement with the drum gear it will prevent the drum gear from paying out, or unwinding, the cable. The pawl will allow further tensioning of the drum gear in a ratchet type fashion, as is known in the art.

The key feature of the present invention is the structure of the drum loading mechanism of the winch 10, the other features of the winch 10 being generally known to those of ordinary skill in the art of manual swivel (or stationary) marine winches for barges and the like. The loading mechanism is mounted on the shaft 24 upon which the drive pinion is mounted. A hand wheel 26 is attached to the shaft 24, with the general construction and operation of the hand wheel 26 also being known in the art. Essentially the hand wheel 26 is used for slack take up and low tension payout. The hand wheel 26 is only partially shown in the figures to provide a view of the remaining elements of the loading mechanism.

The drum loading mechanism includes a spur gear 28 mounted on the shaft 24. The spur gear 28 may be rotated through a compound handle 30, or lever 30, according to the present invention. The lever 30 is mounted to the shaft 24 through a pivoting handle hub 32. A handle base 34 is mounted for rotation about a shaft 36 on the handle hub 32. An elongated handle 38 extends from the handle base 34.

Figure 8:
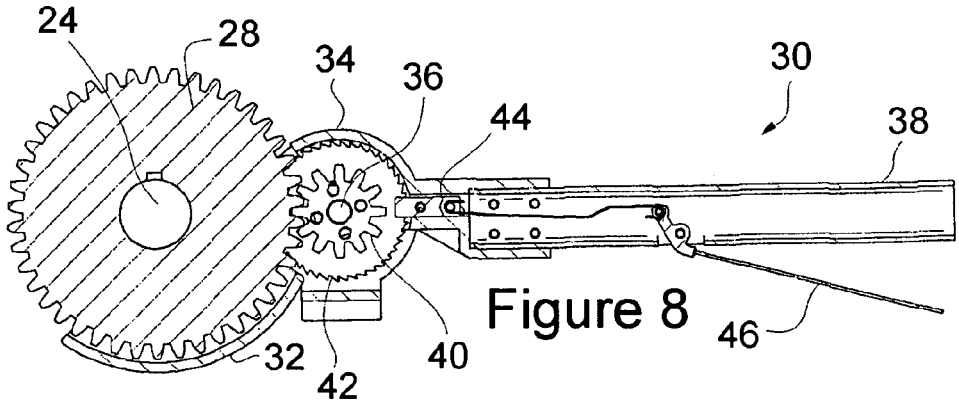
FIG. 8 is a sectional view of the compound handle of FIG. 6.

As shown in FIG. 8, the lever 30 includes a small spur gear 40 and a ratchet gear 42 mounted on the shaft 36 and rotating together, with the gear 40 and gear 42 forming a lever gear assembly. The small spur gear 40 meshes with the spur gear 28. A spring plate 44 is mounted in the handle hub 32 and moveable into engagement with the ratchet gear 42. An engagement assembly or biasing grip 46 is provided to engage the spring plate 44 with the ratchet gear 42, as will be described. The interaction of the elements of the lever 30 will become apparent in the description of the loading operation of the winch 10.

FIG. 1 is a schematic side view of the manual marine winch 10 during slack take up. The hand wheel 26 is used and rotated counterclockwise for the rapid winding of cable during slack take up. The grip 46 is positioned to keep the spring plate 44 out of engagement with the ratchet gear 42, since the compound handle 30 is not being utilized. As a result the spur gear 40 and the ratchet gear 42 will be rotating, also called free wheeling, during the slack take up through rotation of the spur gear 28. As will be understood by those of ordinary skill in the art, the load holding mechanism will be selectively engaging the drum gear preventing unwanted payout during the slack take up. Due to minimum tension during slack take up, the operator may elect to engage the load holding mechanism after some or all of the slack is taken up.

Figure 2:
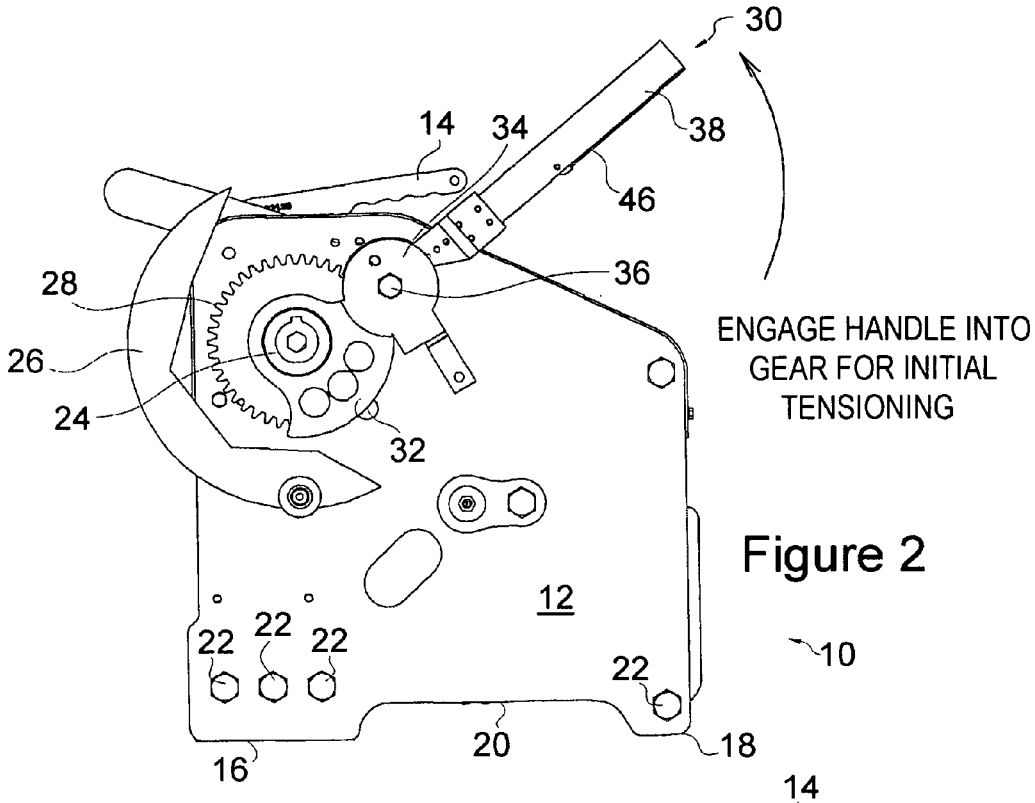
FIG. 2 is a schematic side view of the winch of FIG. 1 during movement of the loading lever to initial tensioning.
Figure 3:
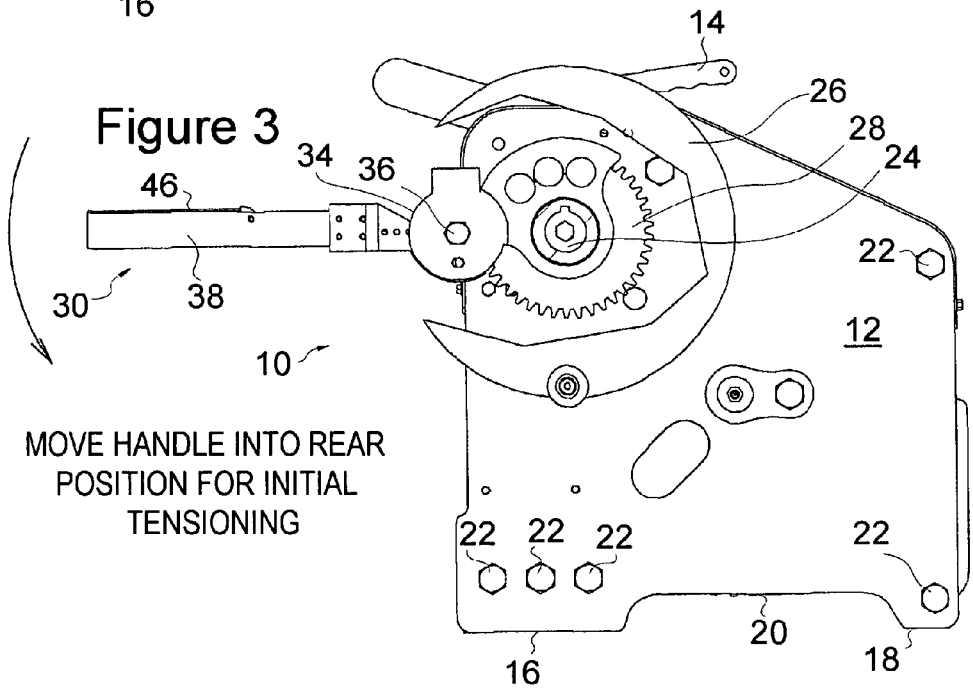
FIG. 3 is a schematic side view of the winch of FIG. 1 during initial tensioning.

After the slack take up the operator will use the lever 30 for further tensioning of the winch 10 and FIG. 2 illustrates movement of the loading lever 30 into an initial tensioning position of the winch 10. It will be noted that the grip 46 is shown in the engaging position in which the spring plate 44 is engaged with the ratchet wheel 42. This will effectively lock the handle base 34 to the ratchet gear 42 and to the spur gear 40 for clockwise rotation of the handle base 34 about the shaft 36. The spring plate 44 is designed to allow ratchet type action of the ratchet gear 42 such that counter clockwise rotation of the handle base 34 relative to the ratchet gear 42 (or clock-wise rotation of the ratchet gear 44 relative to the handle base is permitted). However the engagement of the spring plate 44 to the ratchet gear 42 is not critical for the initial tensioning of the drum with the lever 30. The initial tensioning is accomplished by locking the handle base 34 directly to the spur gear 28 by pivoting the handle base 34 about shaft 36 until the handle base 34 is engaged with, or meshing with, the spur gear 28 as shown in FIGS. 2–3. FIG. 3 is a schematic side view of the winch 10 during initial tensioning. The initial tensioning is accomplished by pivoting the handle base 34 about shaft 36 until the base 34 is locked onto the gear 28, then rotating the base 34 and gear 28 counter-clockwise about shaft 24 to rotate the gear 28 (and the rotation of the gear 28 will rotate the drum gear through the drive pinion on the shaft 24). The initial tensioning, which may also be referred to as gross lever tensioning, may be repeated by disengaging the handle base 34 from the gear 28 by rotating the base 34 clockwise about the shaft 36 until the base 34 disengages the teeth of gear 28, rotating the entire lever 30 about shaft 24 clockwise, re-engaging the base 34 with the gear 28 and repeating. The load holding mechanism will allow for the base 34 to be released from the gear 28 without significant payout of the cable.

Figure 4:
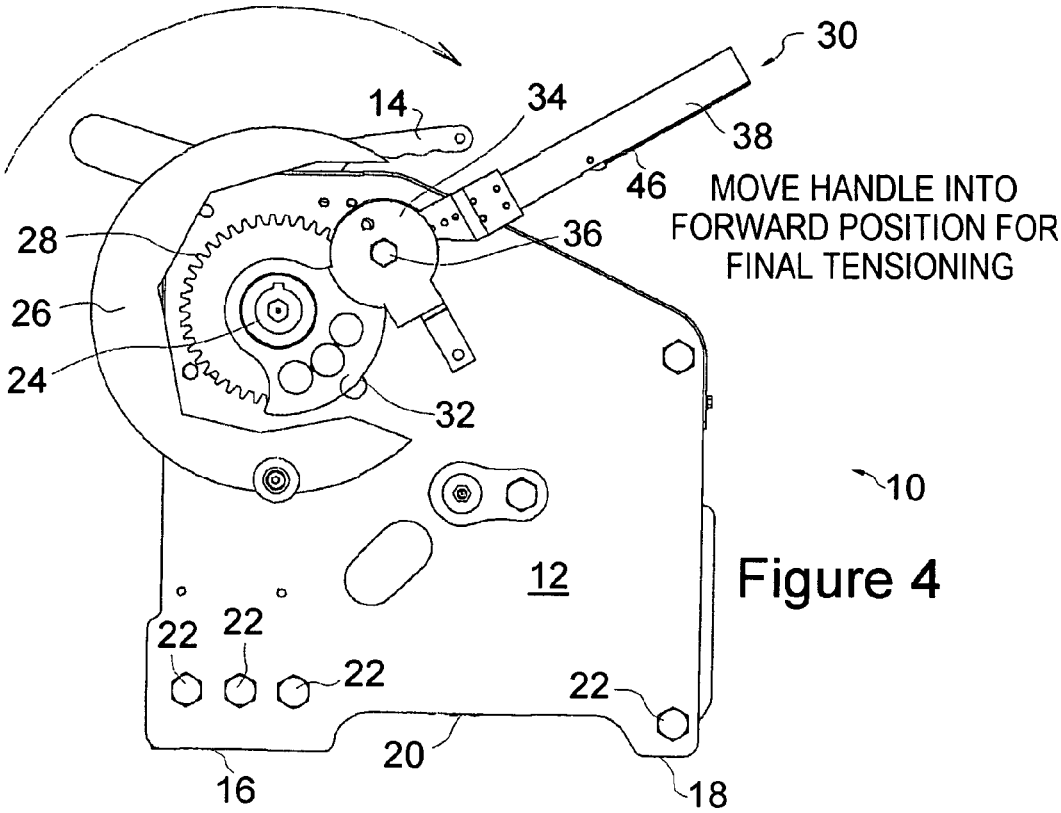
FIG. 4 is a schematic side view of the winch of FIG. 1 during movement of the loading lever to final tensioning.
Figure 5:
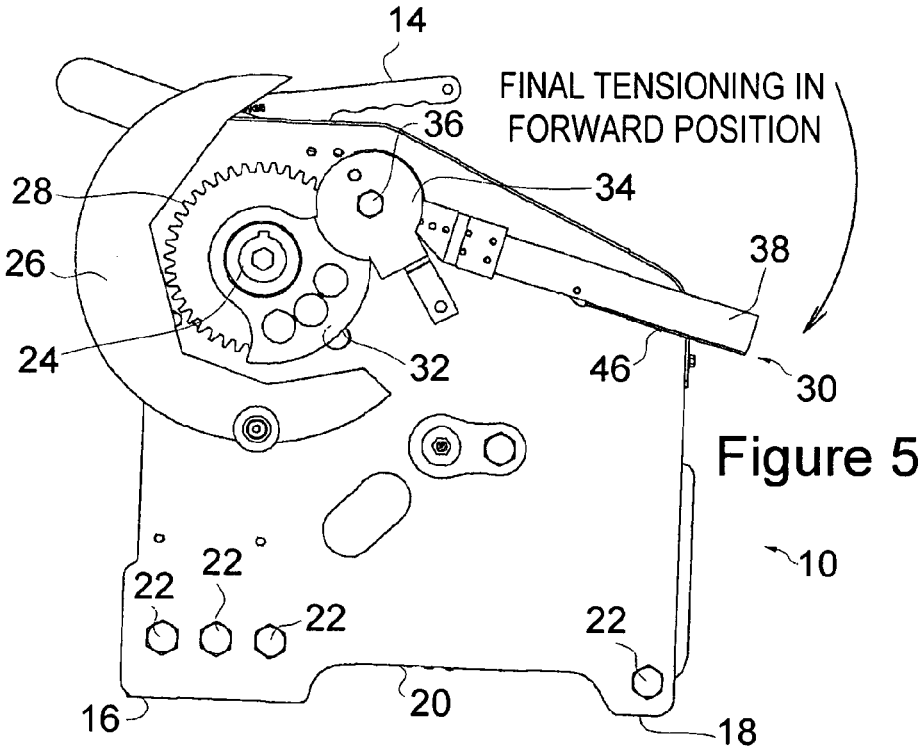
FIG. 5 is a schematic side view of the winch of FIG. 1 during final tensioning.
Figure 6:
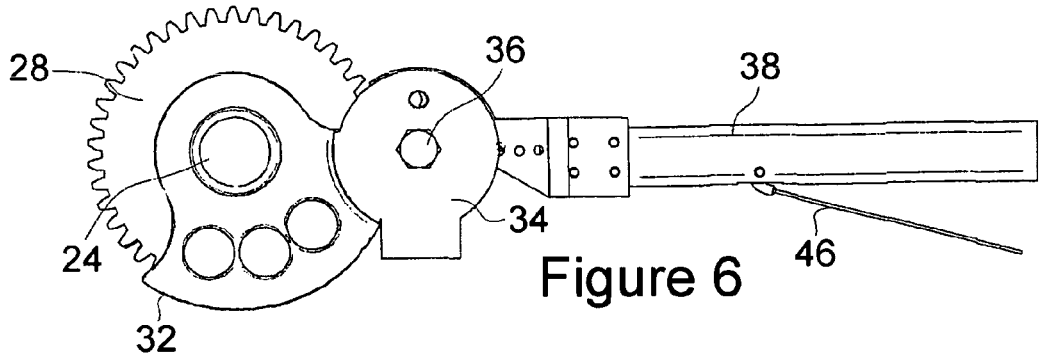
FIG. 6 is a side view of a compound handle for the winch of FIGS. 1–5.
Figure 7:
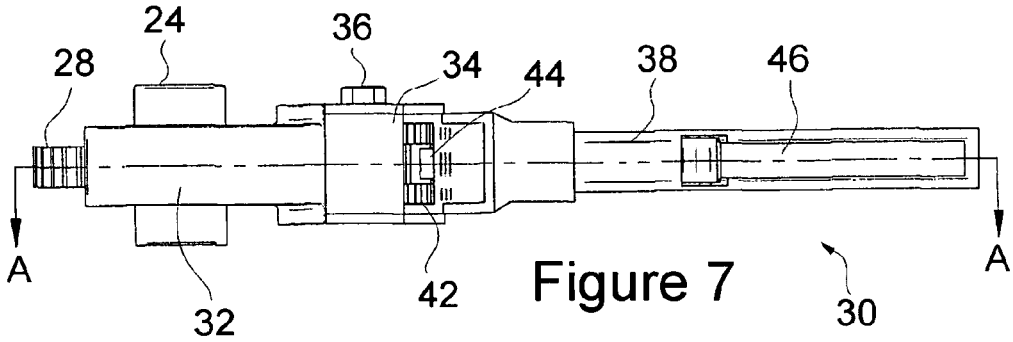
FIG. 7 is a plan view of the compound handle of FIG. 6.

As the load on the winch 10 becomes too great for the operator to further tension the winch 10 using the initial tensioning procedure, the compound handle 30 provides a final, or fine, tensioning procedure that offers a mechanical advantage to the operator. FIG. 4 is a schematic side view of the winch 10 during movement of the loading lever 30 to the final tensioning position. Final tensioning of winch 10 may be accomplished with the handle in the rear position, if desired. Final tensioning disengages the base 34 from the gear 28 and maintains the ratchet type engagement of the spring plate 44 with the ratchet gear 42. FIG. 5 is a schematic side view of the winch 10 during final tensioning wherein clockwise rotation of the base 34 about shaft 36 will cause a clockwise rotation of the ratchet gear 42 and the spur gear 40. The clockwise rotation of the spur gear 42 will rotate the gear 28 counter clockwise to wind the drum (through the drive pinion). The gearing differential between the ratchet gear 42 and spur gear 40 provides the mechanical advantage in the fine tensioning. The fine tensioning may be repeated by counter clockwise rotation of the base 34 about shaft 36 followed by repeating the clockwise tensioning rotation. The gearing ratio and allowable rotation of the base 34 about the shaft 36 (i.e. range of movement between the upper point where the base is engaged with the gear 28 used in gross tensioning and the lower point where the base 34 will abut the hub 32) must be selected to correspond or encompass at least one gear tooth rotation of the drum gear whereby the load holding mechanism will engage at least one further gear tooth during final tensioning.

Various modifications of the present invention may be made without departing from the spirit and scope thereof. For example, the winch may include a safe load release together with the safe loading features of the present invention. The current system can easily retrofitted onto existing marine winches. The described embodiment is not intended to be restrictive of the present invention. The scope of the present invention is intended to be defined by the appended claims and equivalents thereto.

What is claimed is:

1. A manual marine winch comprising:

a pair of spaced side plates;

a rotating drum supported between the side plates;

a drum gear coaxially mounted with the rotating drum;

a pinion drive gear engaging and rotating the drum gear;

a lever supported by at least one side plate for rotating the pinion drive gear, the lever including a lever gearing assembly, wherein the lever is selected to be operated in an initial tensioning mode for rotating the pinion drive gear, and in a final tensioning mode wherein the lever utilizes the lever gearing assembly to provide a mechanical advantage over the initial tensioning mode, wherein the lever bypasses the lever gearing in the initial tensioning mode.

2. The manual marine winch of claim 1 further including a hand wheel for rotating the pinion gear.

3. The manual marine winch of claim 2 further including a spur gear coaxially mounted with the pinion and rotated by the lever.

4. The manual marine winch of claim 1 wherein the lever gearing assembly includes a ratchet gear and a co-axially mounted spur gear.

5. The manual marine winch of claim 4 further including a spur gear coaxially mounted with the pinion and rotated by the lever and meshing with the spur gear of the lever gearing assembly.

6. The manual marine winch of claim 5 wherein the lever includes a lever body pivoted into direct engagement with the spur coaxilly mounted with the drive pinion.

7. The manual marine winch of claim 6 further including a spring plate for selectively engaging the lever gearing assembly.

8. A compound loading lever for a manual marine swivel winch having a drum gear driven by a drive pinion, the lever including a lever gearing assembly, wherein the lever is selected to be operated in an initial tensioning mode for rotating the pinion drive gear, and in a final tensioning mode wherein the lever utilizes the lever gearing assembly to provide a mechanical advantage over the initial tensioning mode, wherein the lever bypasses the lever gearing assembly in the initial tensioning mode.

9. The lever of claim 8 wherein the winch includes a hand wheel for rotating the pinion gear, wherein the lever is mounted coaxially with the hand wheel.

10. The lever of claim 9 further including a spur gear coaxially mounted with the pinion and rotated by the lever.

11. A compound loading lever for a manual marine swivel winch having a drum gear driven by a drive pinion, the lever including a lever gearing assembly, wherein the lever is selected to be operated in an initial tensioning mode for rotating the pinion drive gear, and in a final tensioning mode wherein the lever utilizes the lever gearing assembly to provide a mechanical advantage over the initial tensioning mode, wherein the lever gearing assembly includes a ratchet gear and a co-axially mounted spur gear.

12. The lever of claim 11 further including a spur gear coaxially mounted with the pinion and rotated by the lever and meshing with the spur gear of the lever gearing assembly.

13. The lever of claim 12 wherein the lever includes a lever body pivoted into direct engagement with the spur co-axially mounted with the drive pinion.

14. The lever of claim 13 further including a spring plate for selectively engaging the lever gearing assembly.

* * * * *